United States Patent [19]

Fähnrich et al.

[11] Patent Number: 4,782,268

[45] Date of Patent: Nov. 1, 1988

[54] LOW-PRESSURE DISCHARGE LAMP, PARTICULARLY FLUORESCENT LAMP HIGH-FREQUENCY OPERATING CIRCUIT WITH LOW-POWER NETWORK INTERFERENCE

[75] Inventors: Hans-Jürgen Fähnrich; Walter Hirschmann, both of Munich, Fed. Rep. of Germany

[73] Assignee: Patent Treuhand Gesellschaft fur elektrische Gluhlampen mbH, Munich, Fed. Rep. of Germany

[21] Appl. No.: 23,481

[22] Filed: Mar. 9, 1987

[30] Foreign Application Priority Data

Apr. 7, 1986 [DE] Fed. Rep. of Germany ..... 3611611

[51] Int. Cl.[4] ..... H05B 37/00

[52] U.S. Cl. ..... 315/200 R; 315/244; 315/209 R; 315/224; 315/DIG. 2

[58] Field of Search ..... 375/244, 209 R, 200 R, 375/DIG. 7, DIG. 5, 226, 106, 224, DIG. 2

[56] References Cited

U.S. PATENT DOCUMENTS

| | | | |
|---|---|---|---|
| 4,075,476 | 2/1978 | Pittel | 315/106 |
| 4,370,600 | 1/1983 | Zansky | 315/244 |
| 4,396,866 | 8/1983 | Bay | 315/106 |
| 4,398,126 | 8/1983 | Zuchtriegel | 315/244 |
| 4,398,128 | 8/1983 | Wollank | 315/158 |
| 4,438,371 | 3/1984 | Zuchtriegel | 315/224 |
| 4,438,372 | 3/1984 | Zuchtriegel | 315/244 |
| 4,481,460 | 11/1984 | Kröning et al. | 315/266 |
| 4,544,863 | 11/1985 | Hashimoto | 315/209 R |
| 4,547,706 | 11/1985 | Krummel | 315/209 R |
| 4,553,070 | 11/1985 | Sairanen et al. | 319/209 R |
| 4,572,989 | 2/1986 | Zuchtriegel | 315/209 R |
| 4,647,817 | 3/1987 | Fahnrich et al. | 315/244 |

FOREIGN PATENT DOCUMENTS 3222534 12/1983 Fed. Rep. of Germany .

OTHER PUBLICATIONS

Sipmos Transistors, Siemens Application Notes 1983, chapter 1.9, "Electronic Ballast for Fluorescent Lamps", p. 34, et seq.

Elektronik-Schaltungen (Electronic Circuits) by Waltr Hirschmann publish by Siemens AG, chapter B3.12.

International Electrotechnical Commission Publication 82, p. 47–49, Funk-Enstorung von Elektrischen, DIN 57 875, Teil 2-pp. 1–6.

*Primary Examiner*—David K. Moore

*Assistant Examiner*—Michael Razavi

*Attorney, Agent, or Firm*—Frishauf, Holtz, Goodman & Woodward

[57] ABSTRACT

To suppress introduction of harmonics into the power supply network of a high-frequency operated fluorescent lamp, an input capacitor (C2) connected across a direct current supply (P1, P2) for a transistor push-pull high-frequency circuit—operating at between 25–50 kHz—has a pair of serially connected diodes (D4, D5) connected thereto. The junction point (M2) of the diodes is connected via a coupling capacity (C7) to a common junction (M1) of the push-pull connected transistors (T1, T2). The power line circuit has a line choke (L2, L2') connected, either in advance or behind a rectifier (G1) supplying direct current to the transistor push-pull circuit. The circuit effectively suppresses harmonics, particularly the third harmonic, without introducing additional losses in the circuit, especially if a further capacitor (C8) is connected in the resonance circuit of the fluorescent lamp and to the diode junction (M2) between the two diodes (D4, D5).

22 Claims, 5 Drawing Sheets

LOW-PRESSURE DISCHARGE LAMP, PARTICULARLY FLUORESCENT LAMP HIGH-FREQUENCY OPERATING CIRCUIT WITH LOW-POWER NETWORK INTERFERENCE

REFERENCE TO RELATED LITERATURE

U.S. Pat. No. 4,438,372, Zuchtriegel, assigned to the assignee of the present application, the disclosure of which is hereby incorporated by reference.

U.S. Pat. No. 4,481,460, Kröning et al, the disclosure of which is hereby incorporated by reference.

"SIPMOS Transistors", SIEMENS Application Notes 1983, chapter 1.9, "Electronic Ballast for Fluorescent Lamps", pp. 34 et seq. and equivalent general disclosure "Elektronkschaltungen" ("Electronic Circuits") by Walter Hirschmann, published by SIEMENS AG, chapter B3.12, "Elektronisches Vorschaltgerüt für neue Leuchtstofflampen" ("Electronic Ballast for New Fluorescent Lamps") 50 W/220 V, a-c, pp. 147 to 151, especially page 148.

U.S. Ser. No. 023,456, filed Mar. 9, 1987, Zuchtriegel, now U.S. Pat. No. 4,710,682.

German Patent Disclosure Document No. DE-OS 32 22 534, published Dec. 22, 1983, Schönfeld.

The present invention relates to a high-frequency operating circuit to operate low-pressure discharge lamps, and more particularly fluorescent lamps from a power network.

Background

Low-pressure discharge lamps, typically—and hereinafter for short "fluorescent lamps"—are operated more efficiently if they are operated at frequency ranges which are elevated with respect to ordinary power line frequency. Under "power line frequency" one may also understand direct current - frequency zero. Suitable frequency range for fluorescent lamps is between about 10 and 100 kHz. For many types of operations, a narrower range of between about 25 and 50 kHz is desirable. It is possible, by suitable selection of circuit elements, for example by utilizing push-pull transistorized circuits using MOS-FET transistors, to obtain frequencies between 50 to 100 kHz.

The basic circuit, over which the present application is an improvement, is described in the book "Electronic Circuits" published in German as "Elektronikschaltungen", by Walter Hirschmann. This circuit insures reliable starting of the lamp by automatically forming an ignition voltage, while being efficient. The circuit has a low loss and a high power factor. The circuit, however, introduces a comparatively high proportion of harmonics into the power network, so that some governmental and technical standards cannot always be met and may reduce the power factor, overall, below 0.9.

Basically, the circuit, which is intended to be operated from an a-c power network of, for example, 220 V, 50 Hz, or 110 V, 60 Hz, employs a pair of transistors which are connected in a push-pull circuit. The transistors have a common connection. An operating lamp circuit for the transistors is provided, which includes two windings of a current transformer, each connected to the base of the respective transistors, and a series resonance circuit, having a series inductance which is connected to the common connection of the transistors and, further, through a coupling capacitor to the lamp filament circuit. A particularly suitable current transformer is a ring-type current saturation transformer. Such transformers have high magnetic permeability.

German Patent Disclosure Document No. DE-OS 32 22 534 describes a circuit to reduce the harmonics in connection with a fluorescent lamp circuit. The circuit there described includes a series circuit formed by a storage choke and a diode. The common junction between the storage choke and the diode is connected to two capacitors which, in turn, are connected to the lamp circuit. While the circuit apparently functions well electrically, it has a disadvantage in that the circuit components, in combination with the transistors of the push-pull frequency generator, form a limiting circuit which suppresses the harmonics while, however, in this circuit loading the transistors. The storage choke is part of the high-frequency spark noise suppressor. Additionally, the circuit must be carefully matched to the voltage of the power network and any voltage changes, for example upon change of network voltage due to excessive loading of a particular circuit, supply voltage variations and the like cause the suppression circuit to respond differently than intended by its design.

The Invention

It is an object to provide an operating circuit for fluorescent lamps in which harmonics are effectively suppressed without interfering with the efficiency and reliability of the circuit, and which can be constructed by use of only few and inexpensive circuit components.

One standard which the circuit has to meet is the IEC (International Electrotechnical Commission) Standard 82, which sets forth the permissible harmonic content which may be fed back by a load or user apparatus into a power network. The present invention meets the requirements of this standard.

Briefly, in accordance with the present invention, the lamp circuit input terminals, which define a positive and negative terminal, are connected across an input capacitor, one terminal—typically the positive one—being additionally connected to a series circuit of two diodes, polarized in current passing direction. The network side of the lamp is connected to the end terminal of the series diodes. The junction between the series diodes is connected through a coupling capacitor to the common junction between the push-pull operated transistors, which generate the high frequency. A choke is connected in series with the power line.

Usually, the power line or power supply circuit will be an a-c circuit. The lamp circuit input terminals are supplied from the a-c power line through a rectifier. Selectively, the power line choke, in accordance with features of the invention, may be connected between the rectifier and the power line circuits or between the output of the rectifier and the lamp circuit input terminals.

The power line portion of the overall circuit, as used herein, is that portion of the overall structure in which no transformed or generated portions of the energy used by the lamp are present; rather, only the direct current or power alternating current voltage is present.

The circuit in accordance with the present invention has the advantage that harmonics, and especially the third harmonic, of power line frequency will have a level which meets the IEC Standard 82. The circuit causes only small changes in the output power even if the supply voltage should change beyond desired limits. The voltage at the lamp circuit output terminals, that is, the voltage across the output or smoothing capacitor, will be approximately the level of the peak voltage of the power circuit. This has the additional advantage that the output capacitor can be designed for essentially well known and reasonable voltage levels and not for high lamp circuit pulse or excessive voltages.

The remaining harmonics, higher than the third harmonic, are limited by the inductance of the power line or network choke. The power line choke likewise limits interference voltages due to operation of the lamp circuit to a low limit, for example as set forth in the German Electrical Engineering Standard 0875, Part 2 (VDE 8075, No. 2). If the power line choke is connected between the d-c output of the power rectifier and the input capacitor, connected in parallel thereacross, a diode is preferably connected in parallel to the input capacitor, polarized in blocking direction, in order to suppress high-frequency harmonics of higher order than the third harmonic.

The power line choke preferably is constructed of two blocks of groups of windings, one each being connected in the respective a-c line or d-c line - in dependence of the position of the choke in the circuit.

The circuit is particularly suitable for operation of fluorescent lamps of low power rating.

Lamps having high power rating are preferably operated with a circuit in which the transistor losses are decreased further. Such additional decrease can readily be obtained when using the present circuit in combination with a capacitor which is connected to the junction of the two diodes and a center tap between the resonance inductance and the corresponding electrode of the lamp. The ratio of the capacity of this capacitor with that connected to the common connection between the transistors influences the wave shape, that is, the sinusoidal wave shape, and the energy which is fed back to the transistors. Depending on the lamp type, the capacitor can be directly connected to a tap on the resonance inductance.

The circuit is particularly suitable for lamp fixtures in which the fluorescent lamp is securely connected to the circuit—that is, upon burn-out or failure of the fluorescent lamp, the lamp and the auxiliary circuit have to be replaced together. In some lamp fixtures, it is desirable to provide a replaceable lamp in the circuit. For such operation, the diode junction is not connected to a center tap point between the resonance inductance and the corresponding electrode but, rather, with the preheating circuit current supply of the respective electrode of the lamp itself. Thus, if the lamp is removed from the circuit, no high voltages will appear at the lamp terminals, so that exchange of the lamp can readily be done without danger of shock.

In accordance with a feature of the invention, the circuit can be so constructed that each one of the preheating current supply connections for the electrodes is coupled to the network supply circuits of the other electrode of the lamp by a capacitor. This improves the quality of the resonance circuit. This feature of the invention is particularly suitable to operate fluorescent lamps having high operating voltages or, also, to operate standard fluorescent lamps from a low network voltage supply, for example a supply at 110 V.

DRAWINGS

Figure 4A:
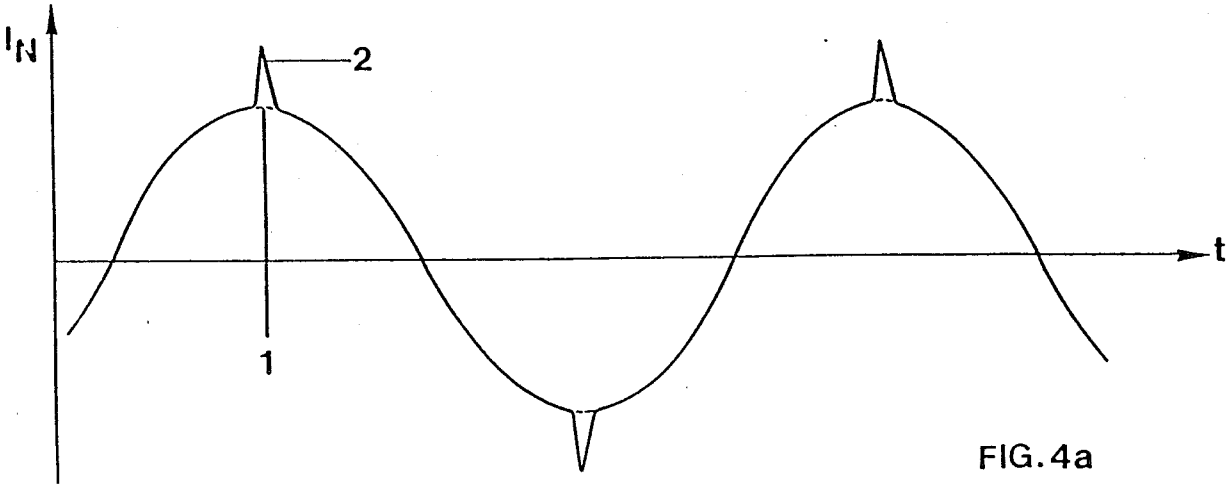
Figure 4B:
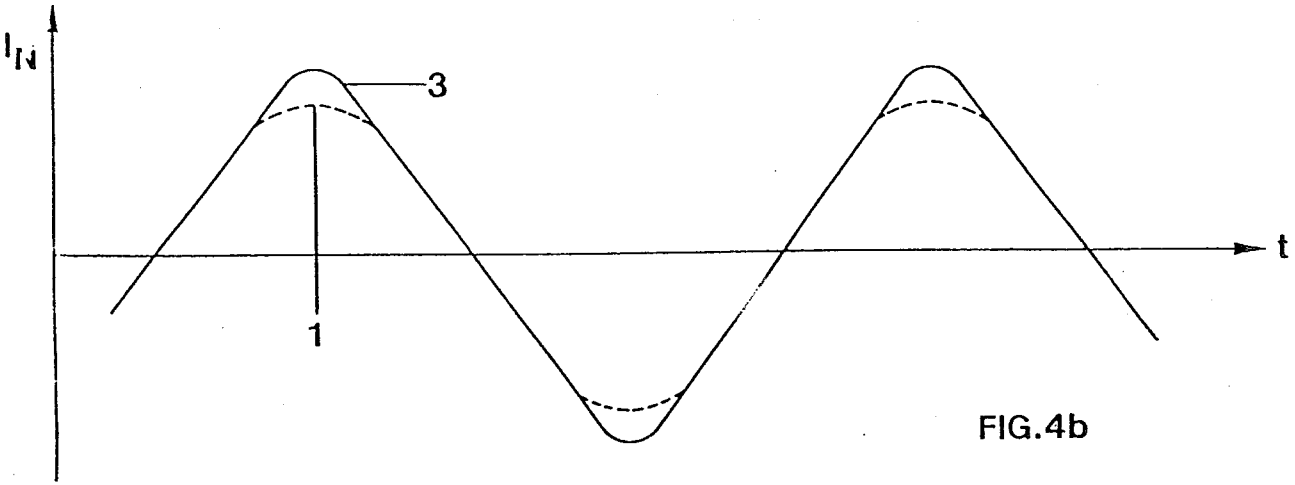
Figure 5:
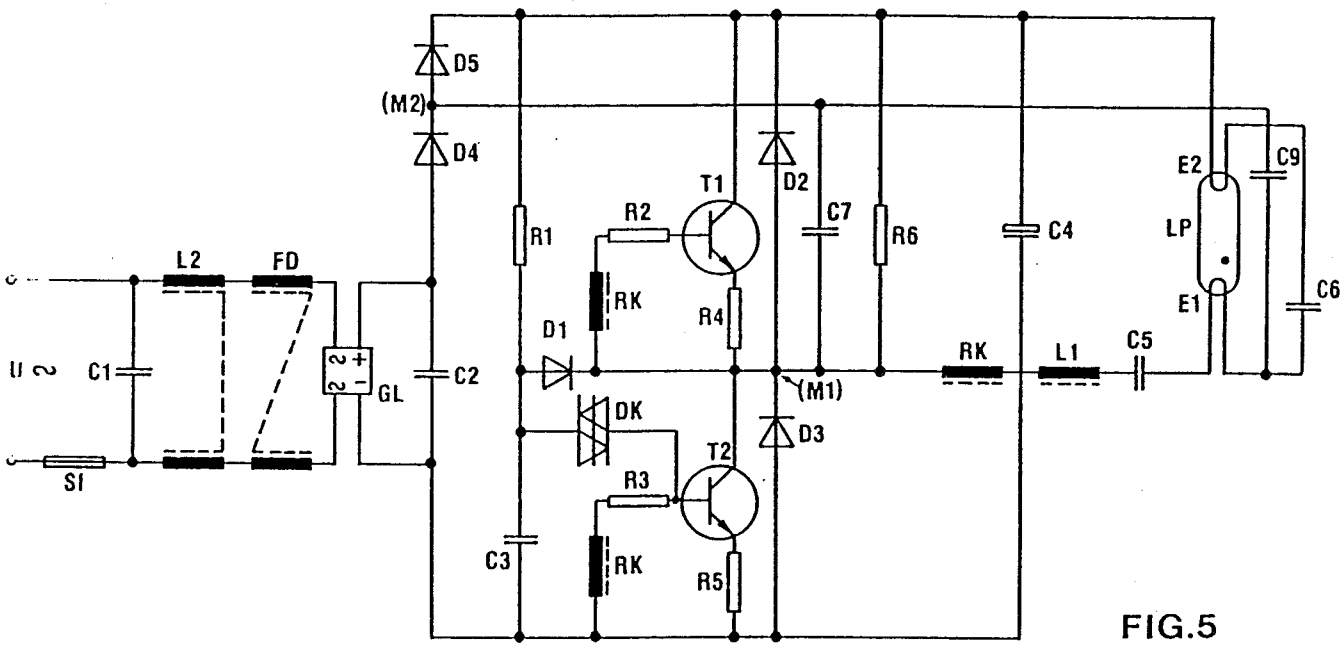
Figure 6:
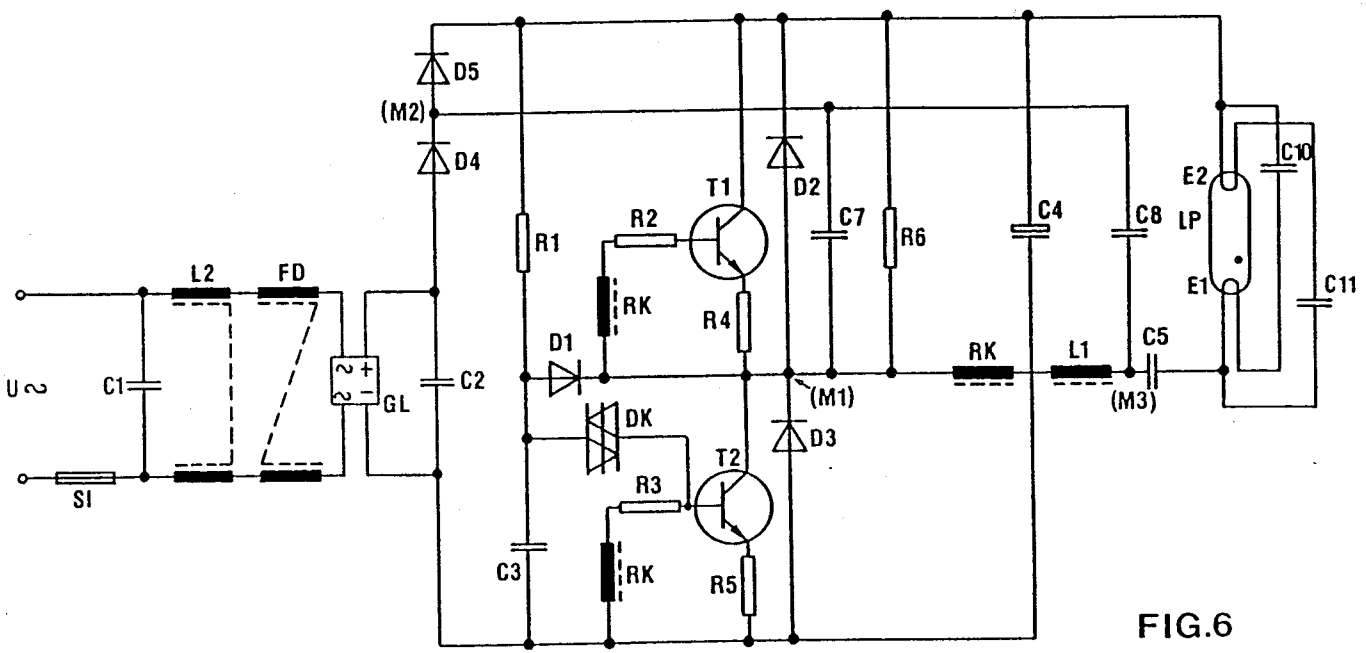

FIG. 4*a* is a graph of the current in the power line, without a current choke;

FIG. 4*b* is a graph similar to that of FIG. 4*a*, with a choke;

FIG. 5 is a circuit in accordance with the invention, permitting exchange of the lamp itself without placing high voltages on the lamp terminals upon replacement; and FIG. 6 is a circuit suitable to operate lamps with high operating voltage or, respectively, from low network voltages, e.g. 110 V.

DETAILED DESCRIPTION

Figure 1:
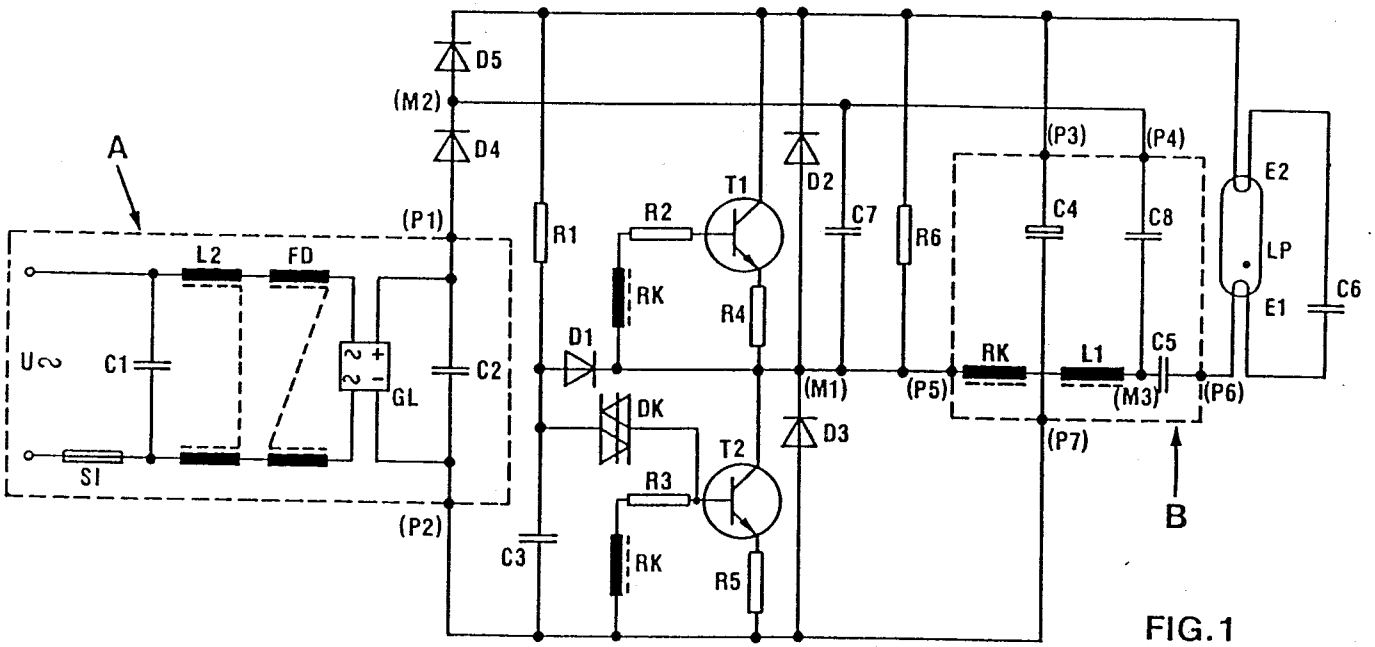
FIG. 1 is a circuit in accordance with the present invention, suitable for integration with a lamp, that is, in which the lamp is securely connected with the circuit components and, upon failure of the lamp, the combination of lamp and circuit has to be replaced.

The circuit of FIG. 1 is especially suitable in a combination fluorescent lamp - operating circuit, in which a fluorescent lamp LP is connected to the circuit and, upon failure of the lamp or the circuit, the entire unit is to be replaced.

The main component of the circuit is a push-pull frequency generator, formed by two transistors T1, T2, with free-wheeling diodes D2, D3 connected in parallel thereto. The diodes D2, D3 may be integrated in the transistors T1, T2.

The push-pull circuit additionally includes transistor-resistors R4, R5 and base coupling resistors R2, R3. A starting circuit is formed by resistors R1 and R6 and the starting capacitor C3. A diac DK is connected to the base of one of the transistors, as shown to the transistor T2. The base resistors R2, R3 are additionally connected to the respective emitter-resistors R4, R5 through respective coils of a feedback transformer RK. The feedback transformer, preferably, is a ring transformer.

The two transistors T1, T2 have their main current path—collector through emitter—serially connected and define, therebetween, a common connection M1. The fluorescent lamp LP has one of its heater electrodes E1 connected to the common connection M1. The other heater electrode E2 is connected to the positive output terminal P1 of the input circuit which includes a rectifier GL. The invention is described for connection to an a-c power supply circuit. A series resonance circuit formed by the resonance inductance L1, the coupling capacitor C5 and the resonance capacitor C6 is provided; the resonance inductance L1 and the coupling capacitor C5 are connected between the common connection M1 of the transistors and the heater electrode E1. The resonance capacitor C6 is connected across the heater electrodes E1, E2 in the preheating circuit of the lamp LP.

The operation of the push-pull frequency generator, in combination with a series resonance circuit, is well known, and described for example in the referenced textbook "Electronic Circuits", page 148, and need not be discussed in detail. Additionally, the patent references assigned to the assignee of the present application describe the operation in general.

The power input circuit, shown in broken line A, is connected to an input supply U, typically alternating current, of, for example 110 V, or 220 V, 50 or 60 Hz. The power terminals are connected through a fuse SI and the customary power filter capacitor C1, in parallel to the input terminals, through a current compensated choke FD to the rectifier GL. In addition, a winding block of a network iron choke L2 is provided, connected in each one of the lines from the power network.

The output of the rectifier GL, polarized as shown in FIG. 1, has an input capacitor C2 connected thereacross.

In accordance with a feature of the invention, two diodes D4, D5 are connected to one of the terminals of the input capacitor C2. The two diodes D4, D5 are rapidly operating diodes and, between themselves, define a common diode junction M2. The common diode junction M2 is coupled over coupling capacitor C7 with the common connection M1 of the push-pull transistors T1, T2, that is, to the junction between the emitter-resistor R4 of transistor T1 and the collector of the transistor T2. Further, a capacitor C8 couples the diode common junction M2 to a junction point M3 between the resonance inductance L1 and the coupling capacitor C5, which are connected to the heater electrode E1 of the lamp LP. A smoothing capacitor, preferably an electrolytic capaciter C4 is connected in parallel to the switching path of the transistors T1 and T2.

Some variations may be made in the circuit. The power input circuit A can be changed to have the form A'—see FIG. 2 —in which the power frequency portion is shown, connected to the terminals P1 and P2 of the power frequency portion circuit. The difference is merely that the input rectifier GL' is connected through the network choke FD, whereas the power line choke L2' is connected to the output of the rectifier GL'. The input capacitor C2' corresponds to the capacitor C2 of FIG. 1. Further, a diode D6, connected in blocking direction with respect to the output polarity of the rectifier GL' is connected across the capacitor C2'. The choke FD', which has the fuse SI' serially connected therewith, and which is connected across the filter capacitor C1', again is a current compensating choke having a winding, each, wound on a core portion. The power line choke L2' likewise has two winding portions or winding blocks.

The circuit of FIG. 1—regardless of whether the network portion A (FIG. 1) or A' (FIG. 2) is used—may be additionally modified in that the second capacitor of the harmonic wave filter can be differently placed. Referring to FIG. 3, which shows a variation of the group of circuits illustrated in the broken line B of FIG. 1, with connection terminals marked identically to FIG. 1, shows that the capacitor C8' is directly connected to a tap of the resonance L1', rather than to the junction point M3. In all other respects, the circuit components of FIG. 3 which have been given prime notations, that is, capacitor C4', C8', feedback winding RK' of the feedback transformer, and the coupling capacitor C5' correspond to the respective elements without prime notation of FIG. 1. The terminals of the group of components B', namely terminals P3 through P7, have been similarly marked in FIG. 1.

Operation, with reference to FIG. 4: The voltage across the input capacitor C2 will be a rectified voltage U2. The smoothing capacitor C4, connected across the first and second series connected diodes D4, D5 and the input capacitor C2, will be a d-c voltage U3. The two series diodes D4, D5 clamp the high-frequency a-c voltage U4, in alternating half waves, to the voltage U2 or U3, respectively, depending on the respective instantaneous difference between the voltages U2 - U3. This voltage is supplied by the capacitor C7 from the push-pull high-frequency generator.

A current flow is thus made possible during the difference phases, in alternating direction, increasingly or decreasingly, of the rectified twice - power line frequency voltage. An essentially sinusoidal current flow from the network power supply will result. This rectified alternating voltage will be, for a 60-cycle supply, at 120 Hz. If capacitor C7 has a suitably large capacity value, excellent sinusoidal current wave shape will be obtained. Possible higher losses on the transistors T1, T2 are eliminated by the capacitor C8 which is connected to the diode junction M2. The sinusoidal wave form can be affected and influenced by suitable selection of capacity relationships of the capacitors C7 and C8, in which the capacitor C7 will be substantially larger than the capacitor C8.

The two figures, FIG. 4*a* and FIG. 4*b*, illustrate the current supplied by the power line network at voltage U, in the circuit A or A', when using the harmonic filter formed by the diodes D4, D5 and the capacitor C7 and, desirably, the capacitor C8, additionally.

FIG. 4*a* illustrates the current flow $I_N$, with respect to time, without the additional line choke L2. This is a network iron choke. The current flow, without the choke L2, is essentially sinusoidal, as clearly shown by the main current curve 1. Remaining peaks, however, as shown at 2, are still present. Comparing current flow of FIG. 4*a* with the similar diagram of FIG. 4*b*, it will be clearly seen that the peaks 2 have been changed from sharp pulse-like needle formed peaks into broadened, flattened, slightly excess current bulges 3. The final current which is taken by the network corresponds to the IEC requirements.

Figure 2:
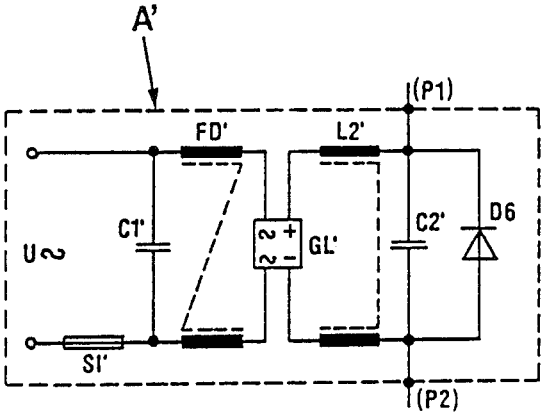
FIG. 2 is a fragementary illustration of a variation of the circuit of FIG. 1.
Figure 3:
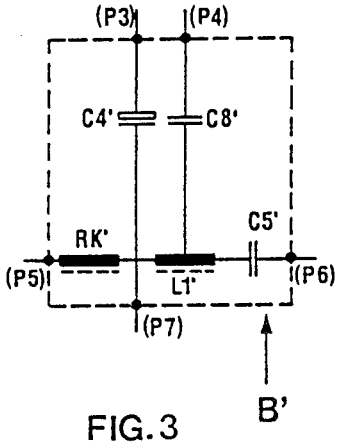
FIG. 3 is a fragmentary circuit showing connection of a harmonic filter with the circuit of FIG. 1.

The power line choke L2 or, in FIG. 2, L2', has two additional advantages. High-frequency disturbances which are derived from the d-c voltage U2 across the input capacitor C2 are substantially reduced; further, the input impedance, for loop control signals, remains inductive.

Referring to FIG. 5: The circuit of FIG. 1 is somewhat varied, to permit exchange of the lamp LP without danger of possible shock hazards. The circuit is essentially identical to that of FIG. 1 and all similar components have been given the same reference numerals.

The circuit differs from FIG. 1 in that the capacitor C8, rather than being connected to the diode junction M2 between the first and second diodes D4, D5 and the junction point M3 (FIG. 1), the capacitor C8 is replaced by a capacitor C9 connected, as before, to the diode junction M2 and then to the terminal of the heater electrode E1 in the preheating circuit of the lamp LP. If the lamp is removed, the high-frequency generator T1, T2 will be disabled and thus effectively disconnected.

Embodiment of FIG. 6: This circuit is particularly suitable for operation of fluorescent lamps which require a high operating voltage, that is, high with respect to network supply voltage; or fluorescent lamps with standard operating voltage but being supplied from lower network voltages as, for example, the U.S. standard voltage of 110 V, 60 Hz. The circuit is identical to the circuit of FIG. 1, except for the heater circuit. In accordance with FIG. 6, the electrode E2 of the lamp LP has its network side connected via a capacitor C10 with the heater side of the electrode E1 of the lamp. The network side of the electrode E1 is connected via a capacitor C11 to the heater side terminal of the electrode E2, so that the capacitors C10, C11 are essentially symmetrically connected to the preheating circuit. This change reduces the damping effect of the electrodes E1, E2 on the oscillatory circuit to one quarter, resulting in higher voltage pulses which, even at lower network voltage, or higher operating voltage requirement of the lamp, permit reliable starting of the lamp.

Suitable circuit components for a 36 W compact fluorescent lamp, for use with a supply voltage of 220 V, 50 Hz, are given on the attached table, by way of example.

Various changes and modifications may be made, and features described in connection with any one of the embodiments may be used with any of the others, within the scope of the inventive concept. For example, the circuits of FIGS. 5 and 6 may be used with the network portion A or A', as selected. The various circuit components can be changed to, for example, operate the lamps at various frequencies. Optimum frequency range is between about 25 and 50 kHz; while the lamps, theoretically, could be operated at higher frequencies, for example between 50 and 100 kHz, the circuit to reduce harmonics becomes less and less effective as the frequency increases above 50 kHz.

TABLE

| | |
|---|---|
| SI | 1 A average delay |
| C1 | 68 nF |
| L2 | 0,6 H |
| FD | 130 mH current-compensated |
| GL | bridge rectifier B 250, C 800 |
| C2 | 33 nF |
| D4, D5 | 1N497 |
| R1 | 470 kΩ |
| C3 | 47 nF |
| D1 | 1N4004 |
| R2, R3 | 10 Ω |
| T1, T2 | BUV 93 |
| R4, R5 | 1,1 Ω |
| DK | A9903 |
| D2, D3 | BA157 |
| C7 | 13 nF |
| R6 | 330 kΩ |
| RK | primary 10 turns, secondary 2 × 4 turns |
| C4 | 22 μF |
| L1 | 0,8 mH |
| C8 | 3,3 nF |
| C5 | 47 nF |
| C6 | 6,8 nF |

We claim:

1. Power frequency harmonic suppressed low-pressure discharge operating lamp circuit, particularly fluorescent lamp (LP) operating circuit, adapted to be connected to a power line circuit (U), at power line voltage and frequency, having lamp circuit input terminals (P1, P2) defining a positive (P1) and a negative (P2) lamp circuit input terminal;

an input capacitor (C2) connected across said lamp circuit input terminals;

a push-pull transistor frequency generator having two alternately conducting transistors (T1, T2) and having a common junction (M1);

and an operating circuit for the transistors, including said lamp (LP), first and second windings (RK) of a current transformer, each winding being connected to the base of a respective transistor (T1, T2), and a series resonance circuit having a series inductance (L1) defining two terminals and having one terminal connected to the common junction (M1) of the transistors (T1, T2) and another terminal connected through a coupling capacitor (C5) and through the lamp filaments (E1, E2) to the resonance capacitor (C6) in the preheating circuit of the lamp (LP), and comprising, in accordance with the invention, a power frequency harmonic suppression circuit including a first and a second diode (D4, D5) serially connected in forward current passing direction and defining a diode junction (M2) between said diodes, said serially connected diodes having one end terminal connected to one terminal (P1) of the input capacitor (C2) and another end terminal connected to the network side of one electrode (E2) of the lamp (LP), a capacitor (C7) connecting the diode junction (M2) and the common junction (M1) of the transistors (T1, T2); and a power line choke (L2, L2') connected between said power line circuit (U) and the lamp circuit input terminals (P1, P2).

2. The circuit of claim 1, wherein the power line circuit (U) comprises an alternating voltage supply at power line frequency;

a rectifier (GL, GL') is provided, and said power line choke (L2, L2') is connected in circuit with the rectifier.

3. The circuit of claim 1, wherein (FIG. 1) the power line circuit (U) comprises an alternating current voltage supply at power line frequency;

a rectifier (GL) is provided, and the power line choke (L2) is connected between the power line circuit (U) and the rectifier (GL).

4. The circuit of claim 1, wherein (FIG. 2) the power line circuit (U) comprises an alternating current voltage supply at power line frequency;

a rectifier (GL') is provided, and the power line choke (L2') is connected between the rectifier and said lamp circuit input terminals (P1, P2).

5. The circuit of claim 4, further comprising a diode (D6) connected across the input capacitor (C2'), polarized in blocking direction with respect to the output of the rectifier (GL').

6. The circuit of claim 1, wherein the power line choke (L2, L2') comprises two winding blocks or groups, each winding block or group being connected in one supply line to the positive and negative lamp circuit input terminals.

7. The circuit of claim 1, wherein (FIG. 1) a further capacitor (C8) is provided, connected between the diode junction (M2) and a junction point (M3) formed by the other terminal connection of the series inductance (L1) and one terminal of the coupling capacitor (C5).

8. The circuit of claim 1, wherein (FIG. 3) the series inductance (L1') includes a winding having a center tap;

and wherein a further capacitor (C8') is provided, connected to the diode junction (M2) and a center tap of the series inductance.

9. The circuit of claim 1, wherein (FIG. 5) an additional capacitor (C9) is provided, having one terminal connected to the diode junction (M2) and another terminal to the preheating circuit of the lamp filaments at a position remote from the connection of the lamp filament circuit which is connected to the coupling capacitor (C5) and hence to the common junction (M1) of the transistors (T1, T2).

10. The circuit of claim 1, further comprising (FIG. 6) a capacitor pair (C10, C11) connecting a first terminal of one electrode (E1) with a second terminal of the other electrode (E2) of the lamp and, respectively, a second terminal of the first electrode (E1) with a first terminal of the second electrode (E2) to provide higher starting voltage pulses and operation of lamps at relatively low power line voltage with respect to lamp operating voltage.

11. The circuit of claim 9, wherein (FIG. 1) the power line circuit (U) comprises an alternating current voltage supply at power line frequency;

a rectifier (GL) is provided, and the power line choke (L2) is connected between the power line circuit (U) and the rectifier (GL).

12. The circuit of claim 9, wherein (FIG. 2) the power line circuit (U) comprises an alternating current voltage supply at power line frequency;

a rectifier (GL') is provided, and the power line choke (L2') is connected between the rectifier and said lamp circuit input terminals (P1, P2).

13. The circuit of claim 10, wherein (FIG. 1) the power line circuit (U) comprises an alternating current voltage supply at power line frequency;

a rectifier (GL) is provided, and the power line choke (L2) is connected between the power line circuit (U) and the rectifier (GL).

14. The circuit of claim 10, wherein (FIG. 2) the power line circuit (U) comprises an alternating current voltage supply at power line frequency;

a rectifier (GL') is provided, and the power line choke (L2') is connected between the rectifier and said lamp circuit input terminals (P1, P2).

15. The circuit of claim 9, wherein (FIGS. 1, 3) a further capacitor (C8, C8') is provided, having one terminal connected to said diode junction (M2) and another terminal connected in circuit with said series inductance (L1) and the coupling capacitor (C5).

16. The circuit of claim 10, wherein (FIGS. 1 and 3) a further capacitor (C8, C8') is provided, having one terminal connected to said diode junction (M2) and another terminal connected in circuit with said series inductance (L1) and the coupling capacitor (C5).

17. The circuit of claim 1, wherein the power line choke (L2, L2') is an iron core choke.

18. The circuit of claim 2, wherein the power line choke (L2, L2') is an iron core choke.

19. The circuit of claim 7, wherein the power line choke (L2, L2') is an iron core choke.

20. The circuit of claim 8, wherein the power line choke (L2, L2') is an iron core choke.

21. The circuit of claim 9, wherein the power line choke (L2, L2') is an iron core choke.

22. The circuit of claim 10, wherein the power line choke (L2, L2') is an iron core choke.

* * * * *